US009935412B1

(12) United States Patent
Smith et al.

(10) Patent No.: US 9,935,412 B1
(45) Date of Patent: Apr. 3, 2018

(54) ELECTRICAL CONNECTOR ASSEMBLY AND A PRODUCT THAT INCLUDES THE ELECTRICAL CONNECTOR ASSEMBLY

(71) Applicant: GM GLOBAL TECHNOLOGY OPERATIONS LLC, Detroit, MI (US)

(72) Inventors: Mark A. Smith, Huntington Woods, MI (US); Susan M. Smyth, Rochester Hills, MI (US); John P. Spicer, Plymouth, MI (US); Daniel Demitrish, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 15/399,950

(22) Filed: Jan. 6, 2017

(51) Int. Cl.
*H01R 13/627* (2006.01)
*H01R 33/74* (2006.01)

(52) U.S. Cl.
CPC ..... *H01R 33/74* (2013.01); *H01R 13/627* (2013.01)

(58) Field of Classification Search
CPC ..... H01R 13/6215
USPC ..... 439/362, 352, 350, 953
See application file for complete search history.

(56) References Cited

U.S. PATENT DOCUMENTS 2,494,428 A * 1/1950 Buck ..... F21V 21/03 174/61
3,786,208 A * 1/1974 Edwards ..... H01R 24/66 200/51 R
4,050,764 A * 9/1977 Hopkins ..... H01R 4/2416 439/465
7,285,005 B2 * 10/2007 Gabrielsson ..... H01R 13/6278 439/362
2012/0115010 A1 5/2012 Smith et al.
2013/0019455 A1 1/2013 Morris
2015/0102621 A1 4/2015 Smyth et al.

* cited by examiner

*Primary Examiner* — Phuong Dinh
(74) *Attorney, Agent, or Firm* — Quinn IP Law

(57) ABSTRACT

A product and an electrical connector assembly includes a first component and a second component. The first component includes a plurality of inner walls spaced from each other to define outer boundaries of respective openings. The first component also includes a first electrical interface. The second component includes a plurality of retention members each having an outer surface and a projection extending from the outer surface of each of the retention members. The outer surface of the retention members is configured to elastically deform along the respective inner walls when inserted into the respective openings such that part of the outer surface of the retention members remains in contact with the respective inner walls when the second component is secured to the first component. The second component also includes a second electrical interface that engages the first electrical interface when the second component is secured to the first component.

20 Claims, 4 Drawing Sheets

ELECTRICAL CONNECTOR ASSEMBLY AND A PRODUCT THAT INCLUDES THE ELECTRICAL CONNECTOR ASSEMBLY

INTRODUCTION

Vehicles can include an interior that defines a passenger compartment configured to a particular design and include an exterior that is configured to a particular design. It is therefore useful to tailor the aesthetic appearance and functionality of the interior and/or the exterior in accordance with the user's preferences.

SUMMARY

The present disclosure provides an electrical connector assembly including a first component and a second component. The first component includes a plurality of inner walls spaced from each other to define outer boundaries of respective openings. The first component also includes a first electrical interface. The second component includes a plurality of retention members each having an outer surface and a projection extending from the outer surface of each of the retention members. The projection of each of the retention members engage the first component adjacent the respective openings to secure the second component to the first component. The outer surface of the retention members is configured to elastically deform along the respective inner walls when inserted into the respective openings such that part of the outer surface of the retention members remains in contact with the respective inner walls when the second component is secured to the first component. The deformation of the outer surface of the retention members is elastically averaged over the retention members that are in contact with the respective inner walls such that the second component is particularly located relative to the first component. The second component also includes a second electrical interface that engages the first electrical interface when the second component is secured to the first component.

The present disclosure also provides a product including a first component and a second component. The first component includes a plurality of inner walls spaced from each other to define outer boundaries of respective openings. The first component also includes a first electrical interface. The second component includes a plurality of retention members each having an outer surface and a projection extending from the outer surface of each of the retention members. The projection of each of the retention members engages the first component adjacent the respective openings to secure the second component to the first component. The outer surface of at least two of the retention members is configured to elastically deform along the respective inner walls when inserted into the respective openings such that part of the outer surface of the retention members remains in contact with the respective inner walls when the second component is secured to the first component. The deformation of the outer surface of the retention members is elastically averaged over the retention members that are in contact with the respective inner walls such that the second component is particularly located relative to the first component. At least one electrical component is supported by one of the first and second components. The second component further includes a second electrical interface that engages the first electrical interface when the second component is secured to the first component such that electricity is delivered to the electrical component.

The detailed description and the drawings or FIGS. are supportive and descriptive of the disclosure, but the claim scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Those having ordinary skill in the art will recognize that all directional references (e.g., above, below, upward, up, downward, down, top, bottom, left, right, vertical, horizontal, etc.) are used descriptively for the FIGS. to aid the reader's understanding, and do not represent limitations (for example, to the position, orientation, or use, etc.) on the scope of the disclosure, as defined by the appended claims. Furthermore, the term "substantially" can refer to a slight imprecision or slight variance of a condition, quantity, value, or dimension, etc., some of which that are within manufacturing variance or tolerance ranges.

Figure 1:
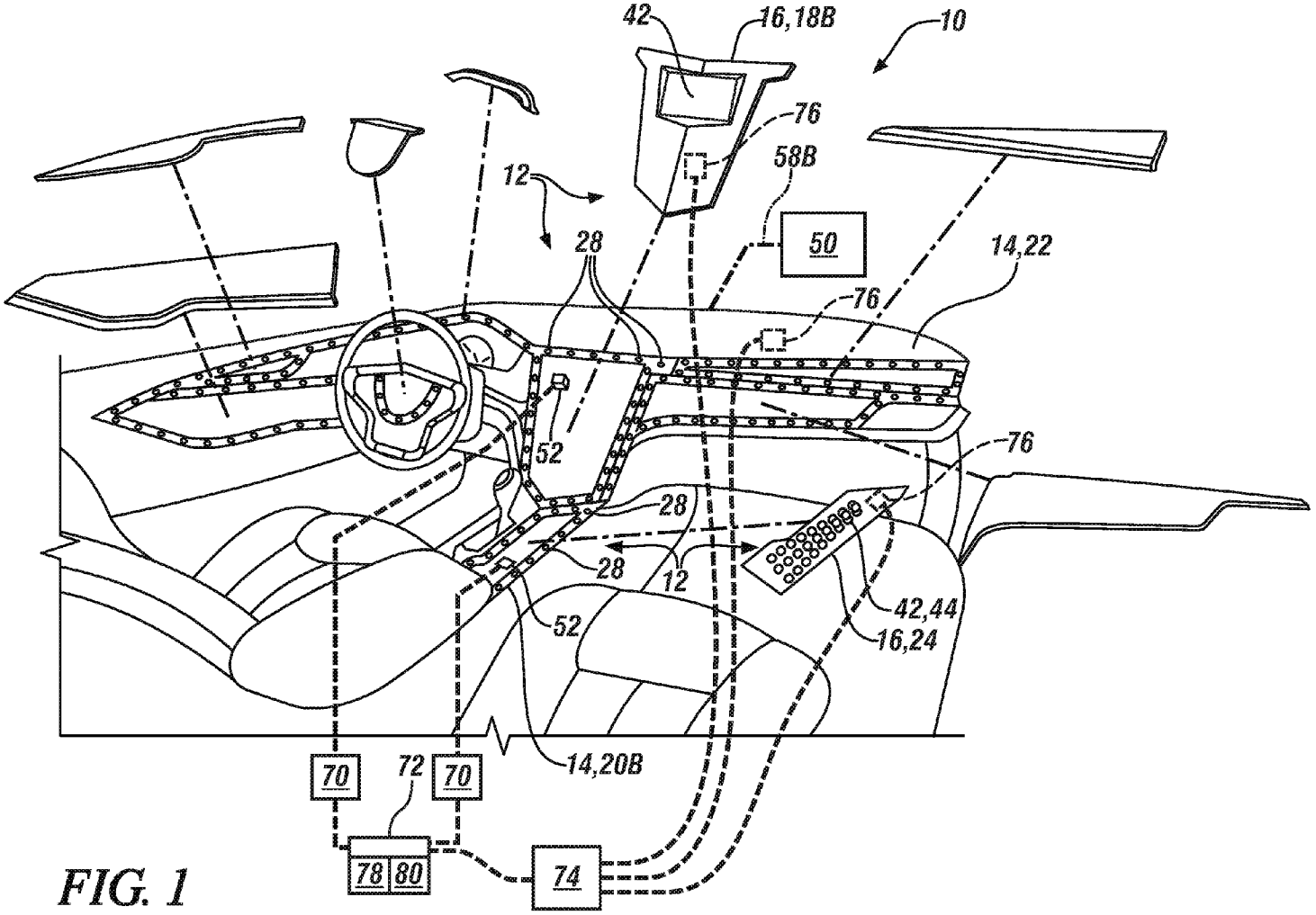
FIG. 1 is a schematic perspective view of a first product.
Figure 2:
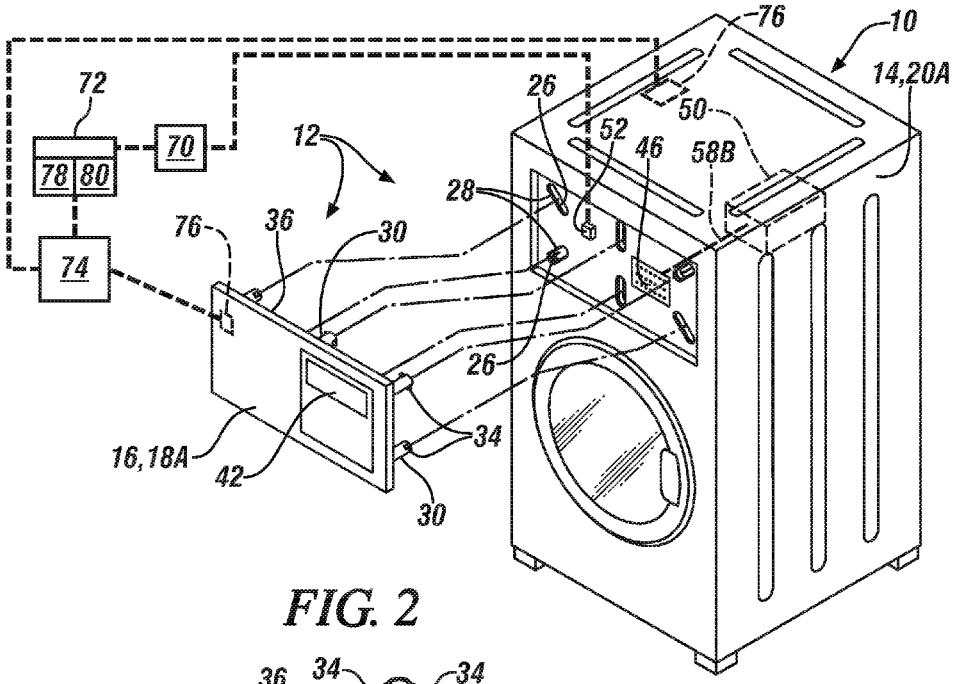
FIG. 2 is a schematic perspective partial exploded view of a second product.

Referring to the FIGS., wherein like numerals indicate like or corresponding parts throughout the several views, a product 10 is generally shown in FIGS. 1 and 2. The product 10 can be any suitable configuration, and non-limiting examples of the product 10 can include a vehicle (see FIG. 1), an appliance (see FIG. 2), a machine, an electronic apparatus, a non-vehicle, a movable platform, equipment, etc.

FIGS. 1 and 2 also illustrate an electrical connector assembly 12. The electrical connector assembly 12 can be incorporated into the product 10. Therefore, for example, the electrical connector assembly 12 can be utilized with the appliance, the vehicle, the machine, the electronic apparatus, the non-vehicle, the movable platform, the equipment, etc.

Continuing with FIGS. 1 and 2, the electrical connector assembly 12 includes a first component 14 and a second component 16. With regard to the product 10, the first component 14 and the second component 16 can each be part of the product 10. The first and second components 14, 16 are attachable and detachable from each other to provide interchangeability or reconfiguration of the components 14, 16 with other configurations of the components 14, 16 or other parts of the product 10. Therefore, the product's appearance and/or function can be tailored to the user's preferences. Additionally, as technology advances or changes, having the ability to reconfigure the product 10 provides versatility to the product 10. The components 14, 16 can be tailored for a new product 10 or retrofitted to an existing product 10 with aftermarket accessories.

As one non-limiting example, if the appliance is a dryer, the user can be presented with different options for the dryer, and the user can select the desired options; and once the options are selected the appropriate electrical panel 18A (one of the components 14, 16, see FIG. 2) can be attached to a frame or a support structure 20A (the other one of the components 14, 16, see FIG. 2) of the dryer. As another non-limiting example, if the product 10 is the vehicle, the first component 14 or the second component 16 can be a dashboard 22 (see FIG. 1), and the other one of the first component 14 or the second component 16 can be an electrical panel 18B (see FIG. 1), a light panel 24 (see FIG. 1), a radio panel, a control panel, an interior trim piece, a monitor, a screen, a radio, etc., that is secured to the dashboard 22. As yet another non-limiting example, if the product 10 is the vehicle, the first component 14 or the second component 16 can be a frame or a support structure 20B, and the other one of the first component 14 or the second component 16 can be an electrical panel 18B, a head lamp assembly, a tail lamp assembly, a blinker assembly, an exterior trim piece, etc.

As best shown in FIG. 2, the first component 14 includes a plurality of inner walls 26 spaced from each other to define outer boundaries of respective openings 28. The openings 28 can be any suitable configuration, and non-limiting examples can include a circular configuration, an oval configuration, an elongated slot, a configuration as shown in FIG. 1, a configuration as shown in FIG. 2, a rectangular configuration, a square configuration, a triangular configuration, a polygonal configuration, a pentagon configuration, a hexagon configuration, an octagon configuration, etc., and combinations thereof.

Figure 3:
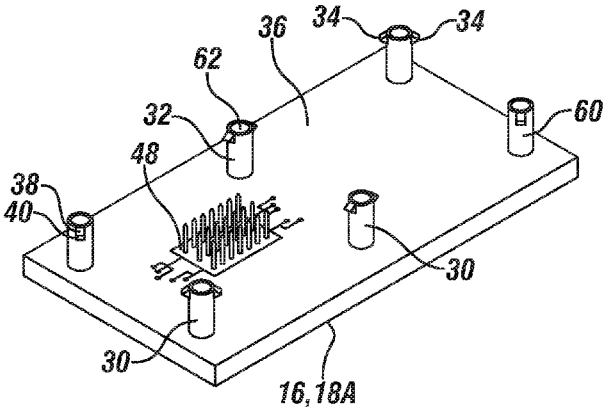
FIG. 3 is a schematic perspective view of a back side of a component of FIG. 2.
Figure 5:
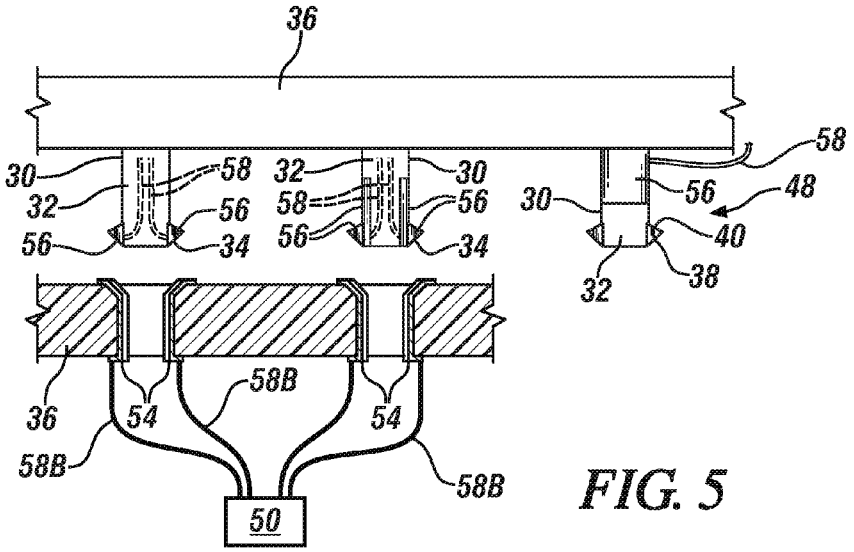
FIG. 5 is a schematic fragmentary view of a first electrical interface and a second electrical interface.
Figure 7:
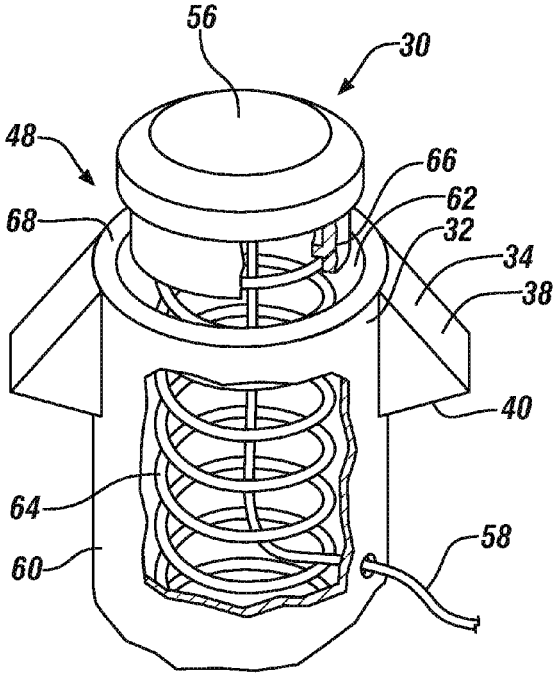
FIG. 7 is a schematic partially fragmentary view of one of the electrical interfaces from FIG. 6.

As best shown in FIGS. 3, 5 and 7, the second component 16 includes a plurality of retention members 30 each having an outer surface 32 and a projection 34 extending from the outer surface 32 of each of the retention members 30. In certain embodiments, the location of the retention members 30 and the openings 28 can be reversed; in other words, the openings 28 can be defined by the second component 16 and the retention members 30 can extend from the first component 14. Alternatively, the first and second components 14, 16 can each include a combination of openings 28 and retention members 30.

The projection 34 of each of the retention members 30 engages the first component 14 adjacent the respective openings 28 to secure the second component 16 to the first component 14. The outer surface 32 of the retention members 30 is configured to elastically deform along the respective inner walls 26 when inserted into the respective openings 28 such that part of the outer surface 32 of the retention members 30 remains in contact with the respective inner walls 26 when the second component 16 is secured to the first component 14. In certain embodiments, the outer surface 32 of at least two of the retention members 30 are configured to elastically deform along the respective inner walls 26 when inserted into the respective openings 28 such that part of the outer surface 32 of the retention members 30 remains in contact with the respective inner walls 26 when the second component 16 is secured to the first component 14.

In order to facilitate the desired alignment of the first and second components 14, 16, the electrical connector assembly 12 includes elastic averaging couplings or interfaces, which can be the retention members 30 as described herein. The deformation of the outer surface 32 of the retention members 30 is elastically averaged over the retention members 30 that are in contact with the respective inner walls 26 such that the second component 16 is particularly located relative to the first component 14. Elastically averaged couplings are based on the principle that alignment can be obtained by using a large number of fairly compliant contacting members. Therefore, the term "elastic averaging coupling" can include a passive alignment coupling, in which two parts are joined using a plurality of interference-fitting contact features. When the two parts are joined, small errors in size and position of the interference-fitting contact features result in multiple elastic deformations that average to yield a particular repeatable alignment. Unlike kinematic couplings, elastic averaging couplings are over-constraining systems in which each constraint is fairly elastic.

Therefore, for all of the configurations of the retention members 30 described herein, the retention members 30 provides a low insertion force when securing together the first and second components 14, 16 and a high retention force to maintain the position of the first and second components 14, 16 relative to each other. All of the retention members 30 utilize elastic averaging, by deformation or deflection, to secure together the first and second components 14, 16.

The retention members 30 can be formed of any suitable elastically deformable material and discussed further below, particularly those materials that are elastically deformable when formed into the features described herein. This includes various metals, polymers, ceramics, inorganic materials or glasses, or composites of any of the aforementioned materials, or any other combinations thereof suitable for a purpose disclosed herein. Many composite materials are envisioned, including various filled polymers, including glass, ceramic, metal and inorganic material filled polymers, particularly glass, metal, ceramic, inorganic or carbon fiber filled polymers. Any suitable filler morphology can be employed, including all shapes and sizes of particulates or fibers. More particularly any suitable type of fiber can be used, including continuous and discontinuous fibers, woven and unwoven cloths, felts or tows, or a combination thereof. Any suitable metal can be used, including various grades and alloys of steel, cast iron, aluminum, magnesium or titanium, or composites thereof, or any other combinations thereof. Polymers can include both thermoplastic polymers or thermoset polymers, or composites thereof, or any other combinations thereof, including a wide variety of co-polymers and polymer blends. In one embodiment, a plastic material is utilized that has elastic properties so as to deform elastically without fracture, as for example, a material comprising an acrylonitrile butadiene styrene (ABS) polymer, and more particularly a polycarbonate ABS polymer blend (PC/ABS). The material can be in any form and formed or manufactured by any suitable process, including stamped or formed metal, composite or other sheets, forgings, extruded parts, pressed parts, castings, or molded parts and the like, to include the deformable features described herein.

The retention members 30 and associated components 14, 16 can be formed in any suitable manner. For example, the retention members 30 and the associated components 14, 16 can be integrally formed, or can be formed entirely separately and subsequently attached together. When integrally formed, the members 30/components 14, 16 can be formed as a single part from a plastic injection molding machine, for example. When formed separately, the members 30/components 14, 16 can be formed from different materials to provide a predetermined elastic response characteristic, for example. The material, or materials, can be selected to provide a predetermined elastic response characteristic of any or all of the elastically deformable retention members 30 or the associated components 14, 16. The predetermined elastic response characteristic can include, for example, a predetermined elastic modulus. Therefore, the first and second components 14, 16 can include a base wall 36 that can be formed of the same material(s) or different material(s) discussed above for the retention members 30. As such, see above for a listing of all of the materials that the base wall 36 can be formed of. The base wall 36 of the first component 14 can define the openings 28, the retention members 30 or a combination of some of the openings 28 and some of the retention members 30, which depends on the configuration of the second component 16. Similarly, the base wall 36 of the second component 16 can define the openings 28, the retention members 30 or a combination of some of the openings 28 and some of the retention members 30, which depends on the configuration of the first component 14.

Turning back to the projection 34, in certain embodiments, the projection 34 can be further defined as a plurality of projections 34 (see FIGS. 3 and 5-9) spaced from each other about the outer surface 32 of each of the retention members 30. It is to be appreciated that all of the retention members 30 can include the plurality of projections 34, or some of the retention members 30 can include the plurality of projections 34 while other retention members 30 include one projection 34.

The projections 34 are configured to allow easy insertion of the retention members 30 into the respective openings 28 and more difficult removal of the retention members 30 from the openings 28. For example, each of the projections 34 can be sloped in one direction for insertion and sloped in a different direction to cause removal to be more difficult. More specifically, the projections 34 can include a first slope 38 (labeled in FIG. 7, and can be the same configuration in all of the FIGS.) and a second slope 40 (labeled in FIG. 7, and can be the same configuration in all of the FIGS.), with the first slope 38 more gradual than the second slope 40. In other words, the second slope 40 is sharper than the first slope 38. Therefore, the projections 34 are designed to ensure that the first and second components 14, 16 remain secured to each other until it is desired to detach the components 14, 16. It is to be appreciated that the projections 34 can be any suitable configuration to provide easy insertion and more difficult removal, and the FIGS. are one non-limiting example.

As best shown in FIGS. 1 and 2, the electrical connector assembly 12 can also include at least one electrical component 42. Depending on the configurations of the first and second components 14, 16, the electrical component 42 can be supported by one of the first and second components 14, 16. In other words, the electrical component 42 can be supported by the first component 14 or the second component 16. In certain embodiments, the electrical component 42 can be supported by the second component 16, as illustrated in the FIGS. The electrical component 42 can be any suitable configuration, and non-limiting examples can include one or more of: a light 44 (see FIG. 1), a light emitting diode (LED), a light bulb, fiber optics, a radio component, a control component, a visual panel component, a button, a switch, a monitor, a screen, the electrical panel 18A, 18B (see FIGS. 1 and 2), an interior electrical component, an exterior electrical component, etc. Therefore, the electrical component 42 can be further defined as a plurality of electrical components 42.

As best shown in FIGS. 3-9, the first component 14 also includes a first electrical interface 46, and the second component 16 also includes a second electrical interface 48 that engages the first electrical interface 46 when the second component 16 is secured to the first component 14. Therefore, when the second electrical interface 48 engages the first electrical interface 46 when the second component 16 is secured to the first component 14, electricity is delivered to the electrical component 42. As such, when the first and second electrical interfaces 46, 48 are connected, an electrical circuit can be completed to deliver electricity to the electrical component(s) 42.

The first and second electrical interfaces 46, 48 can be any suitable configuration in which the interfaces 46, 48 can cooperate with each other to complete an electrical connection, and non-limiting examples can include a conductive material, a contact, a universal serial bus (USB), a mini USB, a connector plug, a standard circular connector plug, a pin and socket connector, a rectangular pin and socket connector, any suitable number of pin connector, for example, a 24-pin connector or a 12-pin connector, etc. Furthermore, non-limiting examples of the interfaces 46, 48 are illustrated in the FIGS. The different configurations of the interfaces 46, 48 that are illustrated in the FIGS. will be discussed below.

Figure 4:
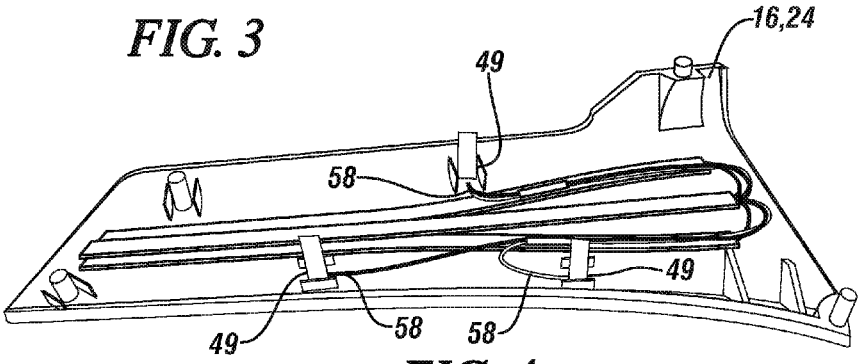
FIG. 4 is a schematic perspective view of a back side of a component of FIG. 1.
Figure 8:
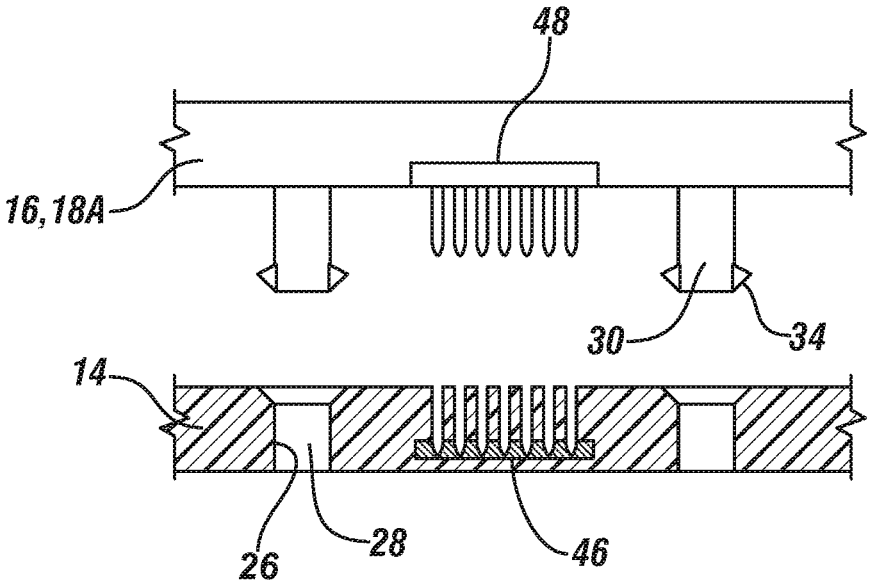
FIG. 8 is a schematic partially fragmentary view of yet another first electrical interface and yet another second electrical interface.
Figure 9:
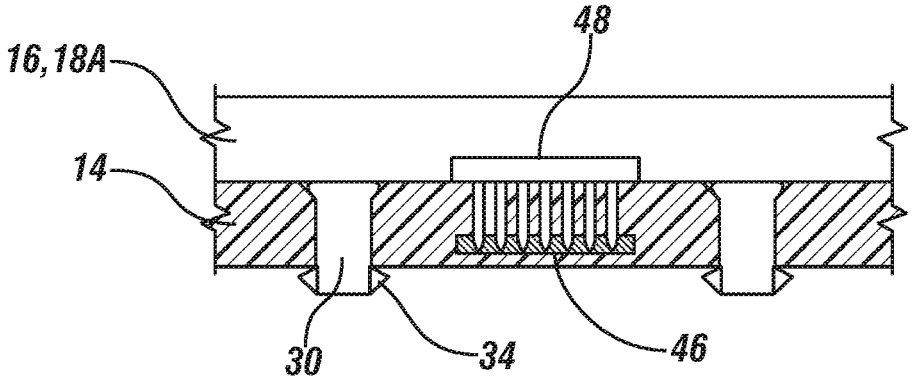
FIG. 9 is a schematic partially fragmentary view of the electrical interfaces of FIG. 8.

In certain embodiments, some of which are illustrated in FIGS. 4-7, the second electrical interface 48 is incorporated into at least one of the retention members 30, and the second electrical interface 48 can engage the first electrical interface 46 when the second component 16 is secured to the first component 14. FIG. 4 is illustrative of some of the locations 49 that the retention members 30 with the second electrical interface 48 can be located. In FIG. 4, the locations 49 have been generically shown, and any of the configurations of the retention members 30 illustrated in FIGS. 5-7 can be utilized. In other embodiments, some of which are illustrated in FIGS. 8 and 9, the first and second electrical interfaces 46, 48 are spaced from the retention members 30.

Turning to FIGS. 1 and 2, one of the first and second electrical interfaces 46, 48 can be electrically connected to a power source 50 to deliver electricity to the electrical component 42. In certain embodiments, the power source 50 is electrically connected to the first electrical interface 46. In other embodiments, the power source 50 is electrically connected to the second electrical interface 48. Therefore, when the first and second electrical interfaces 46, 48 are detached from each other, the electrical circuit is not complete and electricity cannot be delivered to one of the interfaces 46, 48. The power source 50 can be any suitable configuration, and non-limiting examples can include a battery, etc.

Referring to FIGS. 1 and 2, optionally, the electrical connector assembly 12 can include a switch 52. One of the first and second electrical interfaces 46, 48 can include the switch 52, which is transitionable between a closed state delivering electricity to the electrical component 42 and an open state preventing delivery of electricity to the electrical component 42. Furthermore, for example, when the first and second components 14, 16 are detached from each other, electricity will not be delivered to either of the interfaces 46, 48 until the components 14, 16 are secured to each other. In certain embodiments, the first electrical interface 46 can include the switch 52. Furthermore, if utilizing more than two electrical interfaces 46, 48, more than one switch 52 can be utilized to control electricity delivery to another pair of electrical interfaces 46, 48. FIG. 1 illustrates two switches 52 to control the delivery of electricity to two different locations.

Figure 6:
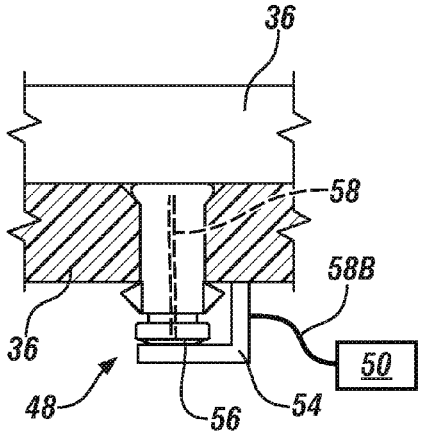
FIG. 6 is a schematic fragmentary view of another first electrical interface and another second electrical interface.

Turning back to the example configurations of the retention members 30 mentioned above, the specific configurations will be detailed below. Referring to FIGS. 5-7, in certain embodiments, the first electrical interface 46 can include a first contact 54 incorporated into one of the inner walls 26, and the second electrical interface 48 can include a second contact 56 incorporated into the outer surface 32 of one of the retention members 30. The first and second contacts 54, 56 engage each other when the second component 16 is secured to the first component 14. When the second electrical interface 48 is incorporated into more than one of the retention members 30, the first contact 54 can be defined as a plurality of first contacts 54 and the second contact 56 can be defined as a plurality of second contacts 56. When utilizing a plurality of contacts 54, 56, one of the first contacts 54 cooperates with one of the second contacts 56, and so on for the number of contacts 54, 56 being utilized.

The first and second contacts 54, 56 can be any suitable configuration, and FIGS. 5 and 6 are non-limiting examples. The first and second contacts 54, 56 can be formed of any suitable conductive material to electrically connect the interfaces 46, 48. Non-limiting examples of the contacts 54, 56 can include one or more of metal, electrolytes, superconductors, semiconductors, copper, plasma, aluminum, silver, etc., and combinations thereof.

At least one electrical wire 58 is connected to the electrical component 42 and connected to the first electrical interface 46 or the second electrical interface 48. In certain embodiments, the at least one electrical wire 58 is connected to the electrical component 42 and the second electrical interface 48. More specifically, the at least one electrical wire 58 is connected to the electrical component 42 and connected to the first contact 54 or the second contact 56. In certain embodiments, the at least one electrical wire 58 is connected to the electrical component 42 and the second contact 56.

The at least one electrical wire 58 can be further defined as a plurality of electrical wires 58, with one of the electrical wires 58 connected to respective second contacts 56. For example, in FIG. 4, three electrical wires 58 are illustrated, with one of the electrical wires 58 connected to three different retention members 30. In this configuration, for example, one of the electrical connections is a positive connection, another one of the electrical connections is a negative connection, and yet another one of the electrical connections is a ground connection. It is to be appreciated that at least one electrical wire 58B can be connected to the power source 50 and the other one of the first and second electrical interfaces 46, 48.

Turning to FIG. 5, in certain embodiments, the second contact 56 can be incorporated into the projection 34. Therefore, in one embodiment, the second contact 56 is incorporated into the outer surface 32 of one of the retention members 30. In another embodiment, the second contact 56 is incorporated into the projection 34 of one of the retention members 30. In yet another embodiment, the second contact 56 is incorporated into the outer surface 32 and the projection 34 of one of the retention members 30. It is to be appreciated that the first contacts 54 can completely surround the outer boundary of the respective opening 28 or can partially surround the outer boundary of the respective opening 28 in FIG. 5. Furthermore, more than one first contact 54 can be disposed in each of the openings 28 for FIG. 5. Additionally, more than one second contact 56 can be disposed on each outer surface 32 of the retention members 30 of FIG. 5.

FIG. 5 illustrates all of these different configurations of the second contact 56, and it is to be appreciated that any of these configurations can be incorporated into the locations identified in FIG. 4. Furthermore, one or more of the retention members 30 can incorporate only one configuration of the second contact 56, or alternatively a combination of more than one of the configurations of the second contact 56 as illustrated in FIG. 5.

Turning to FIGS. 6 and 7, the retention members 30 and the second electrical interface 48 can have a different configuration as compared to FIG. 5. In FIGS. 6 and 7, the retention members 30 can each include a tube 60 defining an aperture 62. In certain embodiments, at least part of the second electrical interface 48 can be disposed in the aperture 62 of one of the retention members 30. The tube 60 of the retention members 30 can each include a respective outer surface 32. It is to be appreciated that optionally, the retention members 30 of FIG. 5 can include the tube 60 defining the aperture 62, or alternatively, the retention members 30 of FIG. 5 can eliminate the aperture 62.

Continuing with FIGS. 6 and 7, the second electrical interface 48 can include a biasing member 64 at least partially disposed in the aperture 62 of the one of the retention members 30 and the second contact 56 coupled to the biasing member 64. The second contact 56 can be disposed outside of the tube 60 of the one of the retention members 30. The biasing member 64 allows the second contact 56 to move relative to the outer surface 32 of the respective retention member 30, thus ensuring the first and second contacts 54, 56 make an appropriate electrical connection. The biasing member 64 can remain in the aperture 62 by any suitable methods, and non-limiting examples can include one or more of a fastener, a friction fit, an interference fit, a coupler, a snap, adhesive, etc. FIG. 6 is illustrative of the first and second contacts 54, 56 engaging each other, which illustrates the movement of the second contact 56 when comparing FIGS. 6 and 7.

Furthermore, the second electrical interface 48 can include an isolator 66 disposed between the second contact 56 and the biasing member 64. The isolator 66 prevents a short circuit. Furthermore, it is to be appreciated if the retention members 30 and/or the first and second components 14, 16 are made of a conductive material, an isolator 66 can be disposed between the components 14, 16, 42 to prevent a short circuit.

Continuing with the embodiment of FIGS. 6 and 7, the tube 60 can extend to a distal end 68 spaced from the second component 16. The biasing member 64 can extend beyond the distal end 68 such that the second contact 56 is exposed outside of the tube 60 at the distal end 68. Furthermore, the electrical wire 58 can be disposed through the aperture 62.

As mentioned above, more than one of the retention members 30 can include the second electrical interface 48, which also applies to the configuration of FIGS. 6 and 7. In certain embodiments, the biasing member 64 is further defined as a plurality of biasing members 64, with one of the biasing members 64 at least partially disposed in one of the aperture 62 of the tube 60 of the respective retention members 30. Furthermore, in this embodiment, the second contacts 56 is further defined as a plurality of second contacts 56 coupled to the respective biasing members 64 and disposed outside of the tube 60 of the respective retention members 30. Also, the tube 60 of each of the retention members 30 extend to a respective distal end 68 spaced from the second component 16. The biasing members 64 each extend beyond the respective distal end 68 such that the second contacts 56 are exposed outside of the tube 60 of the respective retention members 30. The isolators 66 can be further defined as a plurality of isolators 66 disposed between the respective second contacts 56 and the respective biasing members 64. Additionally, the electrical component 42 can be further defined as a plurality of electrical components 42 supported by the second component 16 and at least one electrical wire 58 is connected to the electrical components 42 and the second contacts 56. In this configuration, the electrical wire 58 is disposed through the respective apertures 62. FIGS. 6 and 7 illustrate another configuration, and it is to be appreciated that this configuration can be incorporated into the locations identified in FIG. 4. Furthermore, one or more of the retention members 30 can incorporate only the configuration of FIGS. 6 and 7, or alternatively a combination of more than one of the configurations of FIGS. 5-7.

Optionally, the product 10 can include a sensor 70 in electrical communication with the switch 52. The sensor 70 is configured to signal whether the switch 52 is in the closed state or the open state. Additionally, the product 10 can include a controller 72 in communication with the sensor 70. Therefore, the controller 72 can receive a signal from the sensor 70 regarding whether the switch 52 is in the closed state or the open state. A human-machine interface (HMI) 74 can be in communication with the controller 72, and an identification chip 76 can be coupled to one of the first and second components 14, 16 and be in communication with the HMI 74. The controller 72 conveys information about the sensor 70 to the HMI 74, and the identification chip 76 conveys information to the HMI 74. For example, if the first and second components 14, 16 are secured to each other, but the switch 52 is not indicating that it is in the closed state to deliver electricity to the electrical component 42, then information can be communicated to the HMI 74 that another step needs to be performed.

The identification chip 76 can be utilized to confirm or verify that the desired components 14, 16 have been assembled to the desired product 10. Therefore, the fully assembled product 10 or at various stages of assembly of the product 10, the identification chip 76 can be scanned and information communicated to the HMI 74 to indicate whether the product 10 has been assembled with the proper components 14, 16. The HMI 74 can alert an operator that the correct components 14, 16 have been assembled or that one or more of the components 14, 16 are incorrect. It is to be appreciated that any suitable number of identification chips 76 can be utilized and can be in communication with the HMI 74 to convey information about the product 10. It is to also be appreciated that the HMI 74 can include a machine-machine interface (MMI) or any other suitable interface to convey information about the product 10. Additionally, in certain embodiments, the identification chip 76 can include a radio frequency identification (RFID) chip or a serial number identification. Also, if utilizing the RFID chip, the chip can be an active RFID chip or a passive RFID chip.

The controller 72 can include a processor 78 and a memory 80 on which is recorded instructions for communicating with the sensor 70, the HMI 74, the identification chip 76, etc. The controller 72 is configured to execute the instructions from the memory 80, via the processor 78. For example, the controller 72 can be a host machine or distributed system, e.g., a computer such as a digital computer or microcomputer, and/or as a proportional-integral-derivative (PID) controller device having the processor 78, and, as the memory 80, tangible, non-transitory computer-readable memory such as read-only memory (ROM) or flash memory. The controller 72 can also have random access memory (RAM), electrically erasable programmable read only memory (EEPROM), a high-speed clock, analog-to-digital (A/D) and/or digital-to-analog (D/A) circuitry, and any required input/output circuitry and associated devices, as well as any required signal conditioning and/or signal buffering circuitry. Therefore, the controller 72 can include all software, hardware, memory 80, algorithms, connections, sensors, etc., necessary to communicate with the sensor 70 and/or the switch 52 and/or the HMI 74 and/or the identification chip 76, etc. It is to be appreciated that the controller 72 can also include any device capable of analyzing data from various sensors, comparing data, making the necessary decisions required to communicate with the sensor 70 and/or the switch 52 and/or the HMI 74 and/or the identification chip 76, etc.

The retention members 30 can be formed by three-dimensional printing. Furthermore, at least part of the second electrical interface 48 can be formed by three-dimensional printing. Specifically, the retention members 30 and at least part of the second electrical interface 48 can be formed in the same three-dimensional printing process. For example, the retention members 30 and the second contact 56 are formed in the same three-dimensional printing process. As such, if the second electrical interface 48 is configured as shown in FIG. 5, any of the configurations of the second contacts 56 of this FIG. can be formed on the outer surfaces 32 as the retention members 30 are being formed by the three-dimensional printing. Furthermore, it is to be appreciated, that the first contacts 54 of FIG. 5 can also be formed by three-dimensional printing, as well as the base wall 36 that supports the first contacts 54. As such, if the first electrical interface 46 is configured as shown in FIG. 5, the first contacts 54 of this FIG. can be formed on the base wall 36 as the base wall 36 is being formed by the three-dimensional printing.

While the best modes and other embodiments for carrying out the disclosure have been described in detail, those familiar with the art to which this disclosure relates will recognize various alternative designs and embodiments for practicing the disclosure within the scope of the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. An electrical connector assembly comprising:

a first component including a plurality of inner walls spaced from each other to define outer boundaries of respective openings, and the first component includes a first electrical interface;

a second component including a plurality of retention members each having an outer surface and a projection extending from the outer surface of each of the retention members, with the projection of each of the retention members engaging the first component adjacent the respective openings to secure the second component to the first component, and with the outer surface of the retention members configured to elastically deform along the respective inner walls when inserted into the respective openings such that part of the outer surface of the retention members remains in contact with the respective inner walls when the second component is secured to the first component;

wherein the deformation of the outer surface of the retention members is elastically averaged over the retention members that are in contact with the respective inner walls such that the second component is particularly located relative to the first component; and wherein the second component includes a second electrical interface that engages the first electrical interface when the second component is secured to the first component;

wherein the second electrical interface is incorporated into at least one of the retention members and the second electrical interface engages the first electrical interface when the second component is secured to the first component.

2. The assembly as set forth in claim 1 wherein the first electrical interface includes a first contact incorporated into one of the inner walls and the second electrical interface includes a second contact incorporated into the outer surface of one of the retention members, and wherein the first and second contacts engage each other when the second component is secured to the first component.

3. The assembly as set forth in claim 2 further including at least one electrical component supported by the second component and at least one electrical wire connected to the electrical component and the second contact.

4. The assembly as set forth in claim 2 wherein the second contact is incorporated into the projection.

5. The assembly as set forth in claim 1 wherein the retention members each include a tube defining an aperture, with at least part of the second electrical interface disposed in the aperture of one of the retention members.

6. The assembly as set forth in claim 5 wherein the second electrical interface includes a biasing member at least partially disposed in the aperture of the one of the retention members and a second contact coupled to the biasing member and disposed outside of the tube of the one of the retention members.

7. The assembly as set forth in claim 6 wherein the second electrical interface includes an isolator disposed between the second contact and the biasing member.

8. The assembly as set forth in claim 6 wherein the tube extends to a distal end spaced from the second component, and wherein the biasing member extends beyond the distal end such that the second contact is exposed outside of the tube at the distal end.

9. The assembly as set forth in claim 6 further including at least one electrical component supported by the second component and at least one electrical wire connected to the electrical component and the second contact, and wherein the electrical wire is disposed through the aperture.

10. The assembly as set forth in claim 1 further including at least one electrical component supported by the second component and at least one electrical wire connected to the electrical component and the second electrical interface.

11. The assembly as set forth in claim 10 wherein one of the first and second electrical interfaces is electrically connected to a power source to deliver electricity to the electrical component, and wherein one of the first and second electrical interfaces includes a switch transitionable between a closed state delivering electricity to the electrical component and an open state preventing delivery of electricity to the electrical component.

12. The assembly as set forth in claim 11 wherein the first electrical interface includes the switch and the electrical component is further defined as a light.

13. The assembly as set forth in claim 1 wherein the projection is further defined as a plurality of projections spaced from each other about the outer surface of each of the retention members.

14. The assembly as set forth in claim 1:

wherein the retention members each include a tube defining an aperture, with the tube of the retention members each including a respective outer surface;

wherein the second electrical interface includes a plurality of biasing members, with one of the biasing members at least partially disposed in one of the aperture of the tube of the respective retention members;

wherein the second electrical interface includes a plurality of second contacts coupled to the respective biasing members and disposed outside of the tube of the respective retention members;

wherein the tube of each of the retention members extend to a respective distal end spaced from the second component;

wherein the biasing members each extend beyond the respective distal end such that the second contacts are exposed outside of the tube of the respective retention members;

wherein the second electrical interface includes a plurality of isolators disposed between the respective second contacts and the respective biasing members; and further including a plurality of electrical components supported by the second component and at least one electrical wire connected to the electrical components and the second contacts, and wherein the electrical wire is disposed through the respective apertures.

15. The assembly as set forth in claim 1 wherein the first and second electrical interfaces are spaced from the retention members.

16. A product comprising:

a first component including a plurality of inner walls spaced from each other to define outer boundaries of respective openings, and the first component includes a first electrical interface;

a second component including a plurality of retention members each having an outer surface and a projection extending from the outer surface of each of the retention members, with the projection of each of the retention members engaging the first component adjacent the respective openings to secure the second component to the first component, and with the outer surface of at least two of the retention members configured to elastically deform along the respective inner walls when inserted into the respective openings such that part of the outer surface of the retention members remains in contact with the respective inner walls when the second component is secured to the first component;

wherein the deformation of the outer surface of the retention members is elastically averaged over the retention members that are in contact with the respective inner walls such that the second component is particularly located relative to the first component;

at least one electrical component supported by one of the first and second components; and wherein the second component includes a second electrical interface that engages the first electrical interface when the second component is secured to the first component such that electricity is delivered to the electrical component;

wherein the retention members are formed by three-dimensional printing, and at least part of the second electrical interface is formed by three-dimensional printing.

17. The product as set forth in claim 16 wherein the second electrical interface includes a second contact, and wherein the retention members and the second contact are formed in the same three-dimensional printing process.

18. The product as set forth in claim 16 further including:

a switch transitionable between a closed state delivering electricity to the electrical component and an open state preventing delivery of electricity to the electrical component;

a sensor in electrical communication with the switch and configured to signal whether the switch is in the closed state or the open state;

a controller in communication with the sensor;

a human-machine interface (HMI) in communication with the controller, and wherein the controller conveys information about the sensor to the HMI;

an identification chip coupled to one of the first and second components and in communication with the HMI, and wherein the identification chip conveys information to the HMI.

19. An electrical connector assembly comprising:

a first component including a plurality of inner walls spaced from each other to define outer boundaries of respective openings, and the first component includes a first electrical interface;

a second component including a plurality of retention members each having an outer surface and a projection extending from the outer surface of each of the retention members, with the projection of each of the retention members engaging the first component adjacent the respective openings to secure the second component to the first component, and with the outer surface of the retention members configured to elastically deform along the respective inner walls when inserted into the respective openings such that part of the outer surface of the retention members remains in contact with the respective inner walls when the second component is secured to the first component;

wherein the deformation of the outer surface of the retention members is elastically averaged over the retention members that are in contact with the respective inner walls such that the second component is particularly located relative to the first component; and wherein the second component includes a second electrical interface that engages the first electrical interface when the second component is secured to the first component;

at least one electrical component supported by the second component and at least one electrical wire connected to the electrical component and the second electrical interface;

wherein one of the first and second electrical interfaces is electrically connected to a power source to deliver electricity to the electrical component;

wherein one of the first and second electrical interfaces includes a switch transitionable between a closed state delivering electricity to the electrical component and an open state preventing delivery of electricity to the electrical component.

20. The assembly as set forth in claim 19:

wherein the retention members each include a tube defining an aperture, with the tube of the retention members each including a respective outer surface;

wherein the second electrical interface includes a plurality of biasing members, with one of the biasing members at least partially disposed in one of the aperture of the tube of the respective retention members;

wherein the second electrical interface includes a plurality of second contacts coupled to the respective biasing members and disposed outside of the tube of the respective retention members;

wherein the tube of each of the retention members extend to a respective distal end spaced from the second component;

wherein the biasing members each extend beyond the respective distal end such that the second contacts are exposed outside of the tube of the respective retention members;

wherein the second electrical interface includes a plurality of isolators disposed between the respective second contacts and the respective biasing members; and further including a plurality of electrical components supported by the second component and at least one electrical wire connected to the electrical components and the second contacts, and wherein the electrical wire is disposed through the respective apertures.

* * * * *